US008141616B2

(12) United States Patent
Iwasa et al.

(10) Patent No.: US 8,141,616 B2
(45) Date of Patent: Mar. 27, 2012

(54) GRAVITY CASTING METHOD

(75) Inventors: Katsumi Iwasa, Nagano (JP); Yuji Tai, Nagano (JP); Takahiro Tsunemi, Nagano (JP); Hiroki Takeuchi, Negano (JP)

(73) Assignee: Nissin Kogyo Co., Ltd., Nagano (JP)

( * ) Notice: Subject to any disclaimer, the term of this patent is extended or adjusted under 35 U.S.C. 154(b) by 0 days.

(21) Appl. No.: 12/946,368

(22) Filed: Nov. 15, 2010

(65) Prior Publication Data

US 2011/0114280 A1 May 19, 2011

(30) Foreign Application Priority Data

Nov. 17, 2009 (JP) ..... 2009-261432

(51) Int. Cl.
*B22D 41/04* (2006.01)

(52) U.S. Cl. ..... 164/336; 164/136

(58) Field of Classification Search ..... 164/336, 164/136

See application file for complete search history.

(56) References Cited

U.S. PATENT DOCUMENTS

| | | | | |
|---|---|---|---|---|
| 5,704,413 | A | 1/1998 | Takasaki et al. | |
| 6,557,617 | B1 * | 5/2003 | Bagnoud et al. | 164/4.1 |
| 2009/0229782 | A1 * | 9/2009 | Takada | 164/336 |

FOREIGN PATENT DOCUMENTS

| | | | |
|---|---|---|---|
| JP | 49-29223 | | 3/1974 |
| JP | 02-175065 | A | 7/1990 |
| JP | 02-299744 | A | 12/1990 |
| JP | 07-080628 | A | 3/1995 |
| JP | 7-148547 | A | 6/1995 |
| JP | 08-019852 | A | 1/1996 |
| JP | 09-253829 | A | 9/1997 |
| JP | 2000-042716 | A | 2/2000 |
| JP | 2002282998 | A * | 10/2002 |
| JP | 2005-193262 | | 7/2005 |
| JP | 2006-334657 | A | 12/2006 |
| JP | 2009-196525 | A | 9/2009 |

OTHER PUBLICATIONS

English computer translation JP 2002282998 A.*
Japanese Patent Office Action for Appl. No. 20009-261432 dated Sep. 20, 2011.

* cited by examiner

*Primary Examiner* — Jessica L Ward
*Assistant Examiner* — Erin Saad
(74) *Attorney, Agent, or Firm* — Andrew M. Calderon; Roberts Mlotkowski Safran & Cole, P.C.

(57) ABSTRACT

A gravity casting method includes: situating a molding die having a feeder portion in communication with a cavity above the cavity to a horizontal state and pouring a molten metal from a runner in communication with the cavity; putting the molding die to a state inclined at a predetermined angle during pouring of the molten metal from a stage where the molten metal is filled in the runner and prevailing the molten metal while pouring to the inside of the cavity and the feeder portion; and returning the molding die to the horizontal state after the molten metal has been poured completely, and solidifying the molten metal.

20 Claims, 12 Drawing Sheets

"CONVENTIONAL"

GRAVITY CASTING METHOD

BACKGROUND

1. Field of the Invention

The present invention concerns a gravity casting method.

2. Description of the Related Art

Parts, for example, knuckles used for automobiles are generally cast by a gravity casting method using cast iron, aluminum, or aluminum alloys as a base material. The gravity casting method is a method of filling a molten metal in the entire cavity by utilizing the weight (gravitational force) of the molten metal filled in a feeder upon pouring the molten metal from a runner of a molding die into a cavity and casting the same therein.

As existent gravity casting methods, a stationary casting method of conducting casting while keeping a molding die in a horizontal state, a turnover casting method of pouring a molten metal and then solidifying the same while keeping a molding die in a state rotated by a predetermined angle, and a casting method of tilting or vibrating a molding die have been known (refer to JP-A-2005-193262). However, when it is intended to conduct the step of cooling and solidifying the molten metal poured into the cavity or the like while vibrating the molding die under tilting as described in JP-A-2005-193262, since the molding die is not in the horizontal state, it may result in a problem that the effect of prevailing the molten metal to all top end portions in the cavity under the gravitational effect by the molten metal in the feeder portion (feeder melt) is particularly difficult to be obtained. In addition, in a case where a vibration mechanism has to be provided to the casting apparatus, the device cost increases inevitably.

At first, a gravity casting method according to an existent embodiment is to be described. For example, in a stationary casting method shown in FIG. 7, a product is cast by holding a molding die 101 in a horizontal state, filling a melt (molten metal) poured from a runner 112 so as to prevail to the top end in a cavity 114 by the gravitational force of the molten metal filled in a feeder portion 116 and then cooling to solidify the filled molten metal. In this case, a metal lump formed by cooling the molten metal filled in the flow channel or the like of the runner 112 (hereinafter referred to as "non-product part") is deposited to the cast product.

Since such a non-product portion is a portion which has to be cut off from the cast product and the yield is worsened as the non-product is steeper, it is required to be as small as possible.

For decreasing the non-product portion thereby improving the yield in the existent stationary casting method, the following two methods may be considered. The first is a method of simply shortening the length of a runner 112 to make the non-product portion smaller as shown in FIG. 8. However, as apparent from the drawing, when the length of the runner 112 is merely shortened, since the height of a sprue 110 becomes lower than the height at the upper end of feeder portion 116 and the molten metal is not filled as far as the feeder portion 116, this may cause a problem that the amount of the feeder melt necessary for prevailing the molten metal as far as the top end of a cavity 114 cannot be ensured. The second is a method of shortening the length of a runner 112 while maintaining the height of a sprue 110 necessary to fill the molten metal as far as the upper end of the feeder portion 116 by making the inclination angle $\gamma$ of the runner 112 steeper than that of a usual angle $\beta$ ($\gamma>\beta$) as shown in FIG. 9. According to the method, the amount of the feeder melt necessary for filling the molten metal as far as the upper end of the feeder portion 116 can be ensured. However, as the inclination angle of the runner 112 becomes steeper, a turbulent flow occurs upon pouring of the molten metal into the cavity 114 thereby resulting in a problem that blow or oxide is generated in the product portion (particularly, a portion surrounded by a dotted circle in the drawing).

On the other hand, in a turnover casting method shown in FIG. 10, a runner 112 is provided between a feeder portion 116 and a cavity 114 and a molding die 101 is rotated by a predetermined angle (90° in this case) in a stage where a molten metal 103 is filled in a feeder portion 116 and the cavity 114, and the product is cast by cooling and solidifying the filled molten metal while maintaining the die at that state. In this case, by the provision of the runner 112 between the feeder portion 116 and the cavity 114, the size of the non-product portion can be decreased depending on the simple shape of the product. However, in a case where the molding product has such a complicated shape that arms extend radially, for example, as that of a knuckle used for automobiles, there may be a problem that the feeder portion should be provided on every arm and, as a result, the yield is worsened.

As described above, upon casting a product, particularly, a knuckle used for automobiles, etc. in which the shape of the molding product is formed while being extended radially in the gravity casting method, the molten metal has to be prevailed as far as the top end thereof. However, in the case of the stationary casting method, it was impossible to ensure the amount of the feeder melt capable of prevailing the molten metal as far as the top end of the molding die unless the size of the feeder portion is made unnecessarily larger or the length of the runner is unnecessarily greater. Accordingly, there was a problem that the yield was poor. In this case, when the runner is shortened and the angle is made steeper, although the yield is improved, a turbulent flow is formed in the molten metal thereby possibly generating blow or oxide in the product portion.

On the other hand, in the case of the turnover casting method, there was a problem that the yield is poor, for example, that the feeder portion has to be provided at plurality of portions depending on the shape of the molding product.

Further, in the case of the casting method of pouring the molten metal while situating the molding die gradually horizontally from the tilted state, there was a problem that the molten metal is difficult to be prevailed as far as the top end of the molding die depending on the shape of the molding product.

SUMMARY

In view of the situations described above, this invention is intended to provide a gravity casting method capable of improving the yield and capable of manufacturing a casting product which is inexpensive and at a quality comparable with that of the usual case.

The problems described above can be overcome by solution means which is disclosed below as a preferred embodiment.

According to an aspect of the invention, there is provided a gravity casting method including: situating a molding die having a feeder portion in communication with a cavity above the cavity to a horizontal state and pouring a molten metal from a runner in communication with the cavity; putting the molding die to a state inclined at a predetermined angle during pouring of the molten metal from a stage where the molten metal is filled in the runner and prevailing the molten metal while pouring to the inside of the cavity and the feeder portion; and returning the molding die to the horizontal state after the molten metal has been poured completely, and solidifying the molten metal.

According to the method, even if the molding product is of a complicated shape having radial components, the molten metal can be prevailed in the cavity, to decrease misrun and shrinkage cavity, and maintain the quality of the molding product. Further, since there is no requirement of increasing the feeder portion unnecessarily or increasing the length of the runner or tilting the runner unnecessarily, generation of blow or oxide can be suppressed, and the yield is not deteriorated.

The returning of the molding may be performed after lapse of a predetermined time where the molten metal in the runner is solidified and is not fluidized.

According to the method, since the operation of returning the molding product to the horizontal state (hereinafter referred to as "turn back") is conducted by the time control, the molding product can be maintained at a higher quality.

The returning of the molding may be performed after measuring a temperature of the molding die and lowering of the temperature to a predetermined temperature.

According to the method, since the turn-back is conducted by the temperature control for the molding die, the molding product can be maintained at a higher quality.

In this case, the quality of the molding product can be improved further by measuring the temperature of the runner of the molding die as the temperature for the molding die and monitoring the temperature.

Alternatively, the quality of the molding product can be improved further by measuring the temperature of the feeder portion of the molding die as the temperature for the molding die and monitoring the temperature.

The returning of the molding may be performed after the temperature difference between the temperature of the runner and the temperature of the feeder portion increases to a predetermined value or more.

According to this method, since the turn-back is conducted by the temperature control for the molding die, the molding product can be maintained at a higher quality. Further, the quality of the molding product can be improved further by monitoring the temperature difference.

The returning of the molding may be performed after measuring the temperature of the molten metal in the molding die and lowering of the temperature to a predetermined temperature.

According to the method, since the turn-back is conducted by the temperature control for the molten metal, the molding product can be maintained at a higher quality.

A portion of the runner may be made narrower than other portions.

According to the method, the molten metal less returns to the side of the sprue during turn-back, and misrun or shrinkage cavity can be decreased.

The method may further includes cooling the runner on a side of a sprue before returning the molding die to the horizontal state.

According to the method, the molten metal less returns to the side of the sprue during turn-back by cooling the molding die on the side of the sprue, thereby capable of decreasing misrun and shrinkage cavity.

The method further includes cooling the molten metal in the runner on a side of a sprue before returning the molding die to the horizontal state.

According to the method, the molten metal less returns to the side of the sprue during turn-back by cooling the molten metal on the side of the sprue thereby capable of decreasing misrun and shrinkage cavity.

The method may further includes closing a sprue of the runner before returning the molding die to the horizontal state after completing the pouring of the molten metal.

According to the method, the molten metal less returns to the sprue during the turn-back by closing the sprue thereby capable of decreasing misrun and shrinkage cavity.

According to the disclosed gravity casting method, the yield can be improved and a casting product which is inexpensive and at a quality comparable with that of the existent method can be manufactured.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

A gravity casting method according to the first embodiment of the invention is to be described.

Figure 1A:
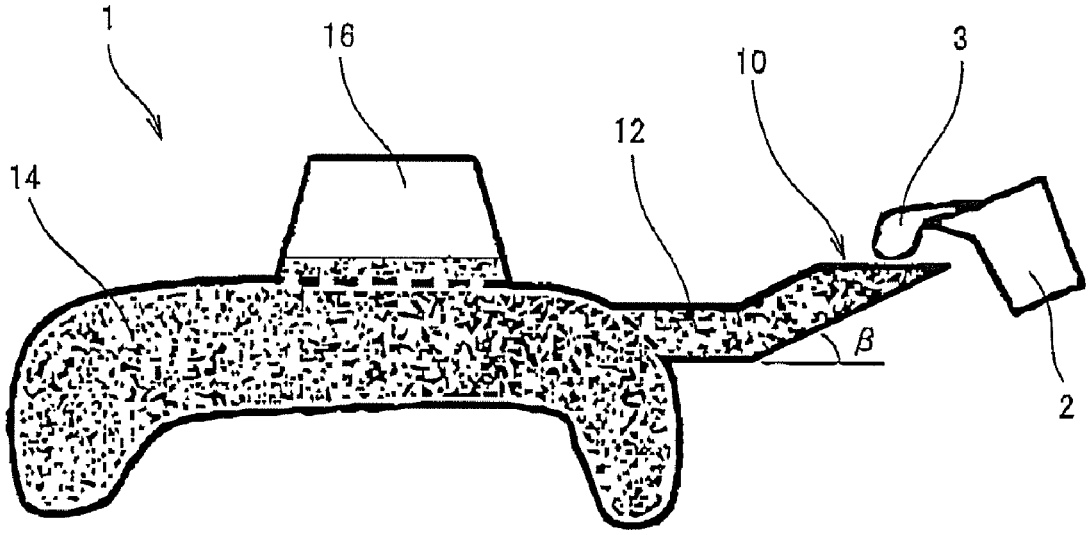
FIGS. 1A to 1C are explanatory views for explaining an example of a gravity casting method according to a first embodiment of the invention.

At first, as shown in FIG. 1A, a molten metal 3 in a ladle is poured from a sprue 10 of a runner 12 of a molding die 1. The poured molten metal is passed through a molten metal flow channel of the runner 12 and is filled in a cavity 14 in communication with the runner 12. In this case, as shown in FIG. 1A, the molten metal is poured till the runner 12 is filled with the molten metal. In this embodiment, description is to be made with reference to an example of using an aluminum alloy as the melt (molten metal).

The molding die 1 used in the gravity casting method according to this embodiment has a runner 12 of a shape having a length which is shortened without changing a tilting angle compared with a runner which is necessary in the existent stationary casting method. According to this embodiment, the non-product portion formed as a metal lump in the portion of the runner 12 after completing the casting of a product can be made as small as possible and the yield can be improved. However, the height of the sprue 10 is lower than the height of the upper end of a feeder portion 16 in view of the shape and the molten metal is not filled in a feeder portion 16 which is in communication with the cavity 14 at a stage where the runner 12 is filled with the molten metal and a necessary amount of the feeder melt cannot be ensured (refer to FIG. 1A).

Figure 1B:
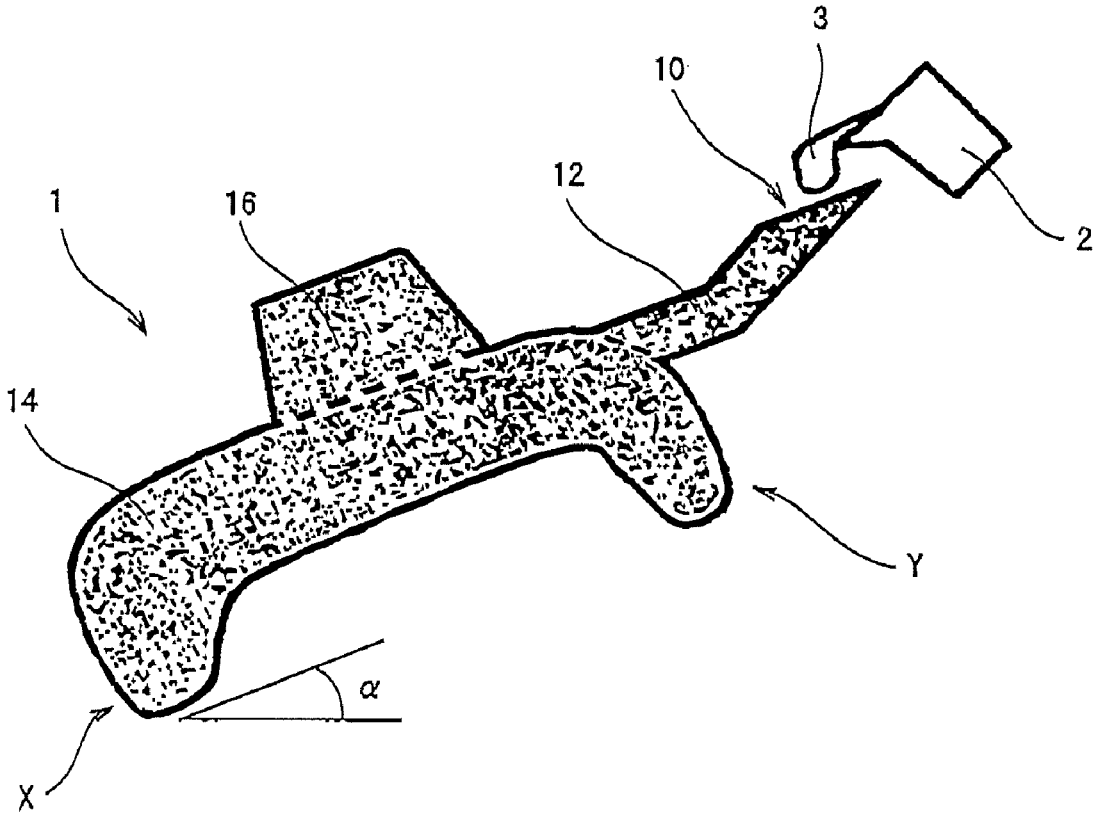

Then, in the gravity casting method according to this embodiment, after pouring the molten metal till it is filled in the runner 12, the molding die 1 is inclined to a predetermined angle $\alpha$ as shown in FIG. 1B. The angle $\alpha$ is determined such that the sprue 10 of the runner 12 situates at a position higher than the position for the upper end of the feeder portion 16. In this case, the molten metal is poured while tilting the molding die 1 from the horizontal state to the inclined state at a predetermined angle $\alpha$. In this state, the molten metal is poured till the runner 12 is filled with the molten metal.

Figure 1C:
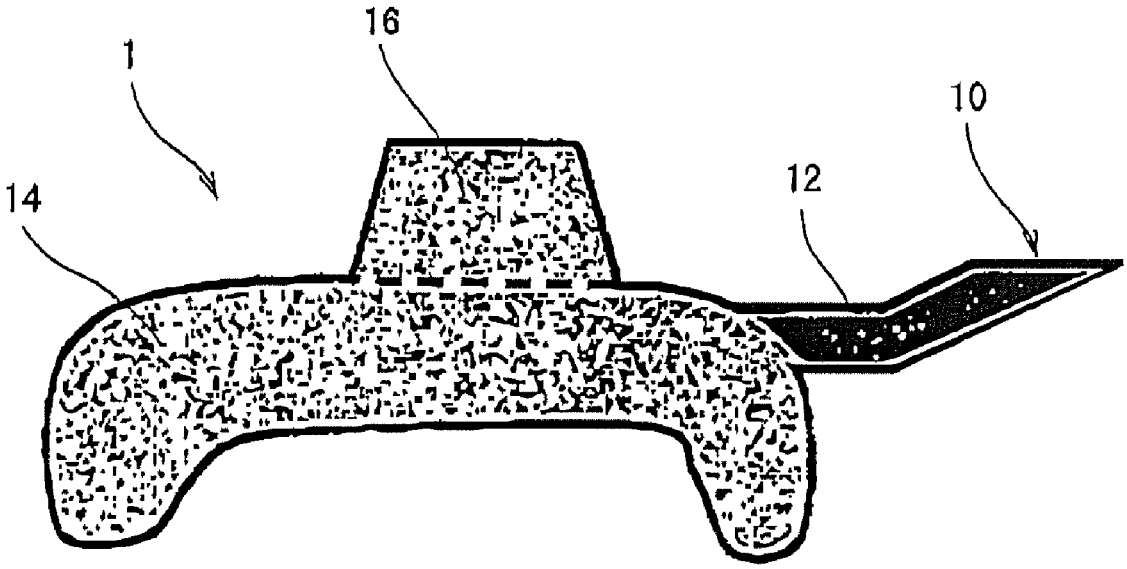

Then, in order to obtain the effect of prevailing the molten metal as far as all top end portions of the cavity 14 by the feeder melt, the molding die 1 is turned back after the molten metal has been poured completely at an optimal timing for the state of the molten metal in the feeder portion 16 and in the runner 12. That is, as shown in FIG. 1C, a step of returning the molding die 1 to the horizontal state and solidifying the molten metal is conducted.

The gravity casting method according to this embodiment has characteristic steps as described below. Specifically, when the molten metal in the runner 12 is cooled to reach a solidification state that the molten metal is not fluidized (including a semi-solidification state that can be dealt as a solid state), turn-back is conducted as shown in FIG. 1C. This can solve the problem of the backward flow described above and the molten metal can be prevented from overflowing from the sprue 10 even when the molding die 1 is returned to the horizontal state.

The semi-solidification state that can be dealt as the solid state means a solid/liquid coexistence state which can be dealt as a solid state that exhibits no substantial fluidity. That is, the semi-solidification state means an intermediate region between a liquid state and a solid state in which a semi-solidification state that exhibits fluidity approximate to a liquid state to a semi-solidification state approximate to a solid state that exhibits no substantial fluidity are present. Accordingly, this embodiment has a feature of including a semi-solidification state that can be dealt as a solid state that exhibits no substantial fluidity among the semi-solidification states described above. As an example, in a case of using an aluminum alloy according to the standards AC4CH (JIS standards) as the molten metal, the semi-solidification state that can be dealt as the solid state is in a region where the temperature is about from 570 to 600° C.

As a first example of the step for conducting the turn-back, it may be considered a method of measuring the temperature of the molten metal in the runner 12 and conducting the turn-back in a stage where the temperature of the molten metal lowers to a predetermined temperature for a solidification state. According to the method, since the turn-back can be conducted by the temperature control for the molten metal, the molding product can be maintained at a high quality.

As a modified example, when a correlation between the temperature of the molten metal in the runner 12 and the temperature of the molten metal in the cavity 14 is previously determined, for example, by conducting a test casting, the state where the temperature of the molten metal in the runner 12 is lowered to a predetermined temperature for the solidification state can be judged also by measuring the temperature of the molten metal in the cavity 14.

As a second example of the step for conducting the turn-back, there may be considered a method of previously determining a predetermined time that the molten metal in the runner 12 is solidified to such an extent that it is not fluidized, for example, by conducting a test casting and conducting the turn-back after lapse of the predetermined time from the completion of the pouring of the molten metal. According to this method, since the turn-back can be conducted by the time control, the molding product can be made uniform and maintained at a higher quality.

As a third example of the step for conducting the turn-back, there may be considered a method of previously determining the temperature of the molding die 1 where the molten metal in the runner 12 is solidified to such an extent that it is not fluidized, for example, by a test casting and conducting the turn-back after the temperature of the molding die 1 is lowered to the predetermined temperature.

In this case, there may be considered a method of measuring the temperature for a portion of the runner 12 or a method of measuring the temperature for a portion of the feeder portion 16 as the temperature for the molding die 1. This is an effective method in a case where direct measuring for the temperature of the molten metal is difficult.

As a fourth example of the step for conducting the turn-back, there may be considered a method of previously determining a value for the temperature difference between a temperature for the runner 12 and the temperature for the feeder portion 16 of the molding die 1 when the molten metal in the runner 12 is solidified to such an extent that it is not fluidized, for example, by conducting a test casting and then conducting the turn-back after the temperature difference increases to greater than the predetermined value.

By the way, the temperature difference usually tends to increase along with lapse of time, that is, the molten metal in the runner 12 is solidified earlier.

As described above, the turn-back step is conducted after the molten metal has been poured completely, and a step of cooling and solidifying the molten metal poured into the cavity 12 or the like is conducted in a state where the molding die 1 is returned to the horizontal state. According to the method, an effect of prevailing the molten metal to all top end portions in the cavity by the molten metal in the feeder portion 16 (feeder melt) is obtained also in a case where the molding product is in a complicate shape having radial components such as a knuckle used for automobiles. Accordingly, misrun and shrinkage cavity can be decreased and the quality of the molding product can be maintained at a quality comparable with that of the product cast by the gravity casting method according to the existent stationary casting method. Further, when the molten metal in the cavity 14 is cooled, the volume of the molten metal is decreased by shrinkage to form pores, particularly, in a case where the melt (molten metal) is an aluminum alloy or the like. However, since the molten metal in the feeder portion 16 (feeder melt) is entered and is supplemented in the gaps, this provides an effect capable of preventing the generation of defects such as misrun or shrinkage cavity to the product to be cast.

Successively, a gravity casting method according to a second embodiment of the invention is to be described.

Figure 2:
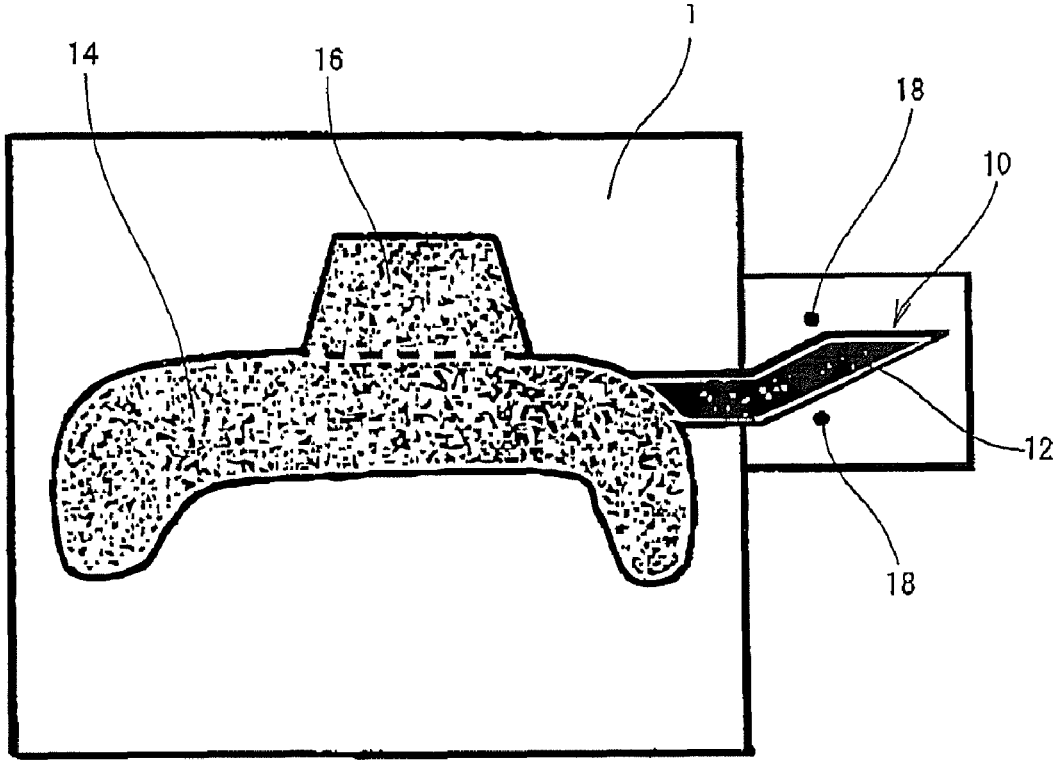
FIG. 2 is a schematic view for explaining an example of a molding die used in a gravity casting method according to a second embodiment of the invention.

The gravity casting method according to this embodiment uses a molding die 1 having a thermocouple 18 near the runner 12 as shown in FIG. 2 and conducts the steps as have been described for the gravity casting method according to the first embodiment described above.

According to the method, since the stage where the temperature of the molten metal in the runner 12 is lowered to a predetermined temperature for solidification can be judged by monitoring the temperature near the runner 12, turn-back can be conducted by the temperature control and the molding product can be maintained at a higher quality.

Successively, a gravity casting method according to a third embodiment of the invention is to be described.

Figure 3A:
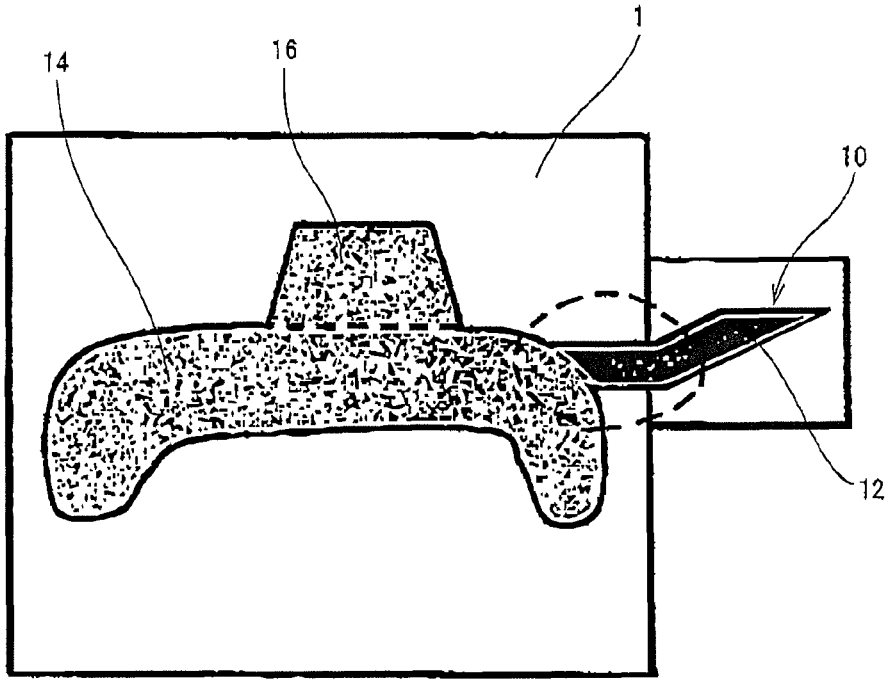
FIGS. 3A and 3B are schematic views for explaining an example of a molding die used in a gravity casting method according to a third embodiment of the invention.
Figure 3B:
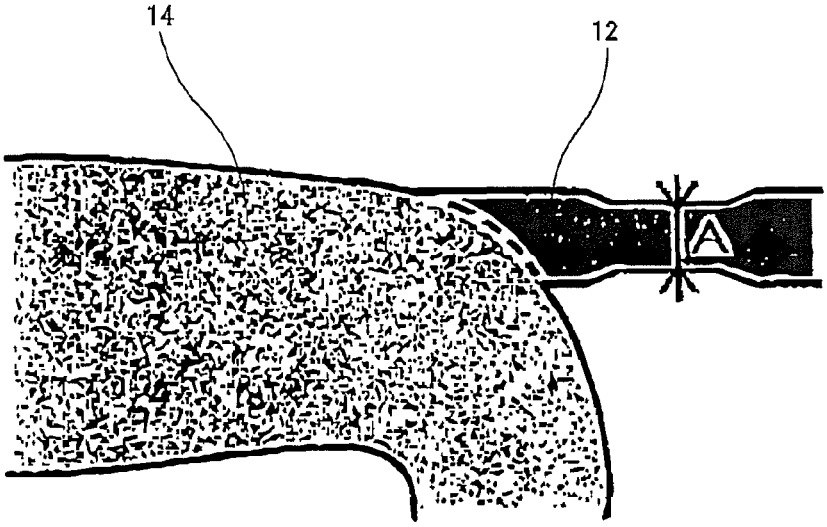

The gravity casting method according to this embodiment conducts the steps as have been described for the gravity casting method according to the first embodiment described above by using a molding die 1 in which a runner 12 has a restricted portion A at the midway thereof which is formed narrower than other portions as shown in FIGS. 3A and 3B. FIG. 3B is an enlarged view for a portion surrounded with a dotted circle in FIG. 3A.

According to the method, since the molten metal in the restricted portion A has a smaller capacity per unit length than that of the molten metal in other portions of the channel, solidification is promoted. The molten metal solidified in the restricted portion A functions as a backflow stopper upon turn-back. That is, a turn-back step to be conducted in a stage where the molten metal in the runner 12 is in such a solidified state that it is not fluidized can be started in an early stage. As a result, the feeder effect of the feeder portion obtained in the horizontal state can be provided in an early stage and product defects such as misrun and shrinkage cavity can be decreased. Further, since the tact time can be shortened, the production cost can be decreased.

Successively, a gravity casting method according to a fourth embodiment of the invention is to be described.

The gravity casting method according to this embodiment has steps that have been explained in the gravity casting method according to the first embodiment described above and further has a feature of including the step of cooling the molten metal in the runner 12 on the side of the sprue 10 before conducting the step of returning the molding die 1 to the horizontal state after completing the pouring of the molten metal.

According to the method, solidification of the molten metal on the side of the sprue 10 is promoted. The molten metal solidified in the runner 12 functions as backflow stopper during turn-back. That is, the turn-back step to be conducted at the stage where the molten metal in the runner 12 is in a solidified state to such an extent that it is not fluidized can be started in an early stage. As a result, the feeder effect of the feeder portion 16 provided in the horizontal state can be obtained in an early stage and the product defects such as misrun and shrinkage cavity can be decreased. Further, since the tact time can be shortened further, compared with a gravity casting method according to the third embodiment described above, the production cost can be decreased.

As a first example of the step of cooling the molten metal on the side of the sprue 10 in the runner 12, there may be considered a method of feeding a blow to the molten metal in the sprue 10 thereby directly cooling and solidifying the molten metal.

As second example of the step of cooling the molten metal on the side of the sprue 10 in the runner 12, there may be considered a method of the runner 12 on cooling the side of the sprue 10 thereby indirectly cooling and solidifying the molten metal.

Figure 4:
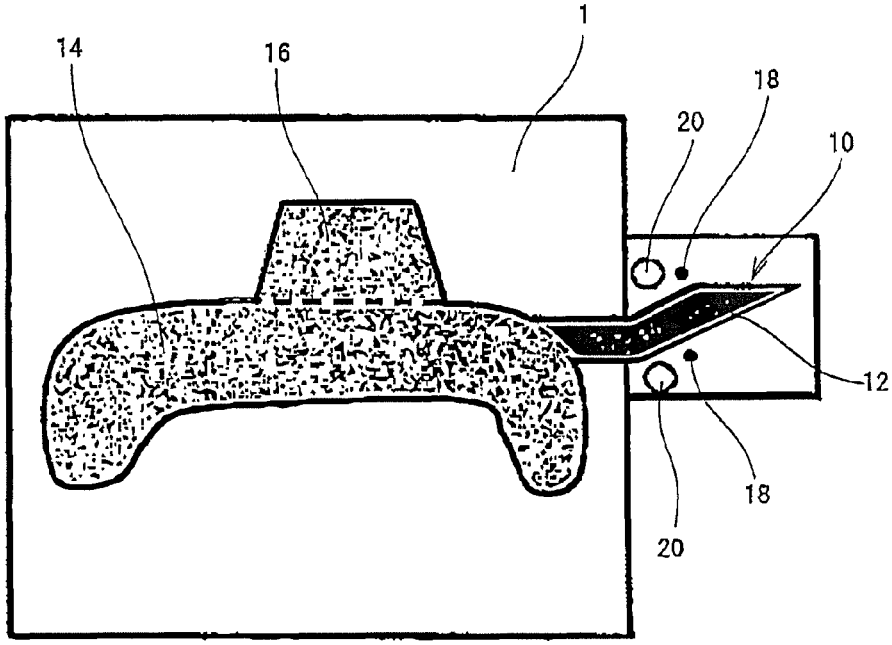
FIG. 4 is an explanatory view for explaining an example of a gravity casting method according to a fourth embodiment of the invention.

Specifically, there may be considered, as shown in FIG. 4, a method of providing a cooling port 20 near the sprue 10 of the runner 12 of the molding die and flowing water or air therethrough, thereby cooling the vicinity of the sprue 10 and depriving the heat from the molten metal in the inside.

Successively, a gravity casting method according to a fifth embodiment of the invention is to be described.

Figure 5:
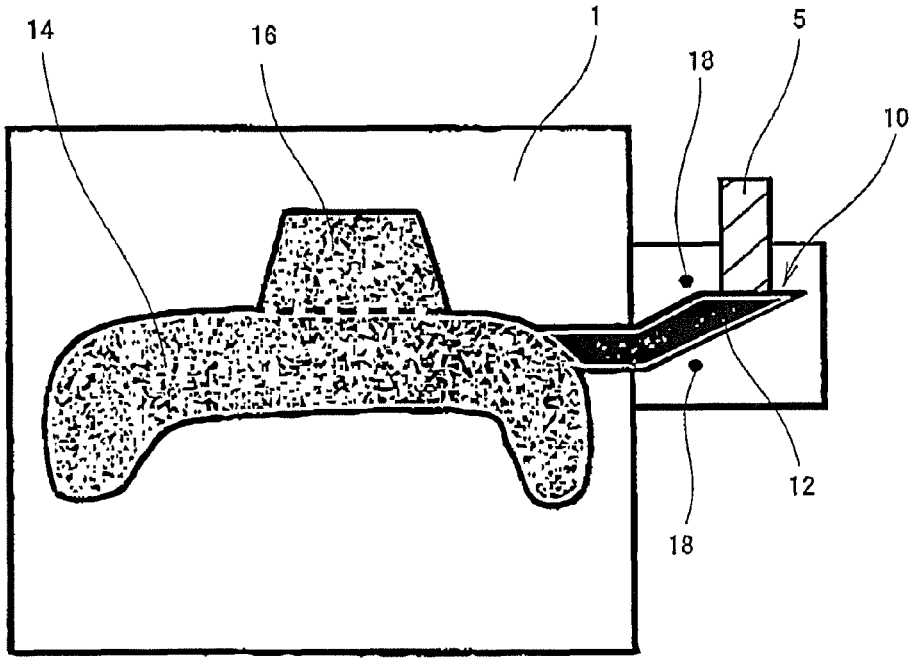
FIG. 5 is an explanatory view for explaining an example of a gravity casting method according to a fifth embodiment of the invention.

The gravity casting method according to this embodiment has steps that have been described for the gravity casting method according to the first embodiment described above and, further has a feature of including a step of abutting a chilling metal 5 comprising a material such as iron against the vicinity of a sprue 10 of a runner 12 of a molding die 1 before conducting the step of returning the molding die 1 to the horizontal state after completing the pouring of the molten metal (refer to FIG. 5).

According to this method, since the vicinity of the sprue 10 is cooled by the cooling metal 5 and the heat is deprived from the molten metal in the inside, solidification of the molten metal on the side of the sprue 10 is promoted. Accordingly, in the same manner as the fourth embodiment described above, an effect capable of starting the turn-back step in an early stage is obtained.

Successively, a gravity casting method according to a sixth embodiment of the invention is to be described.

The gravity casting method according to this embodiment has steps that have been described for the gravity casting method according to the first embodiment described above and also has a feature of including a step of closing the sprue 10 of the runner 12 before conducting the step of returning the molding die 1 to the horizontal state after completing the pouring of the molten metal.

Figure 6A:
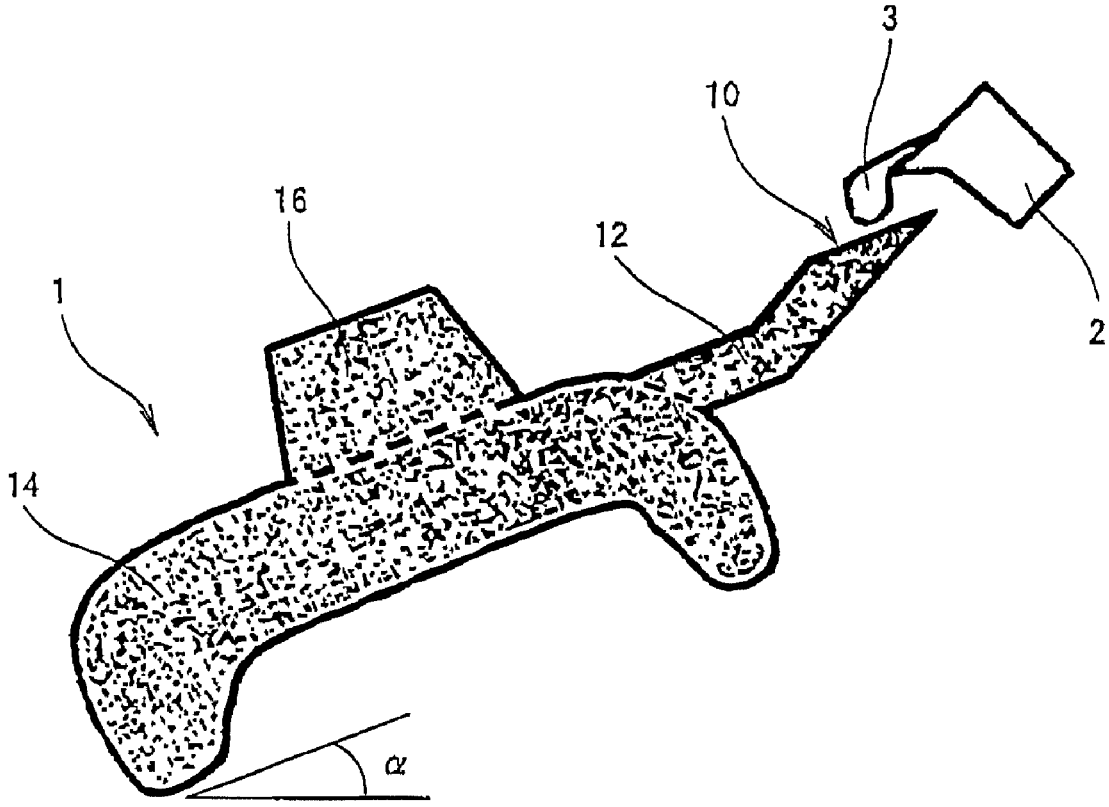
FIGS. 6A to 6C are explanatory views for explaining an example of a gravity casting method according to a sixth embodiment of the invention.
Figure 6B:
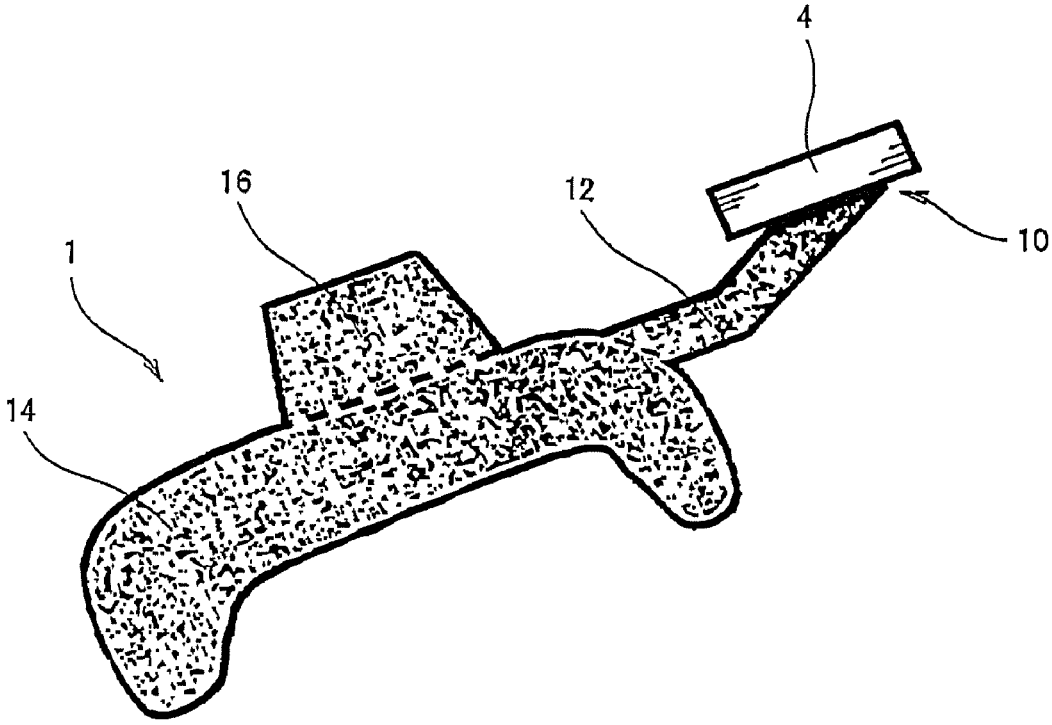
Figure 6C:
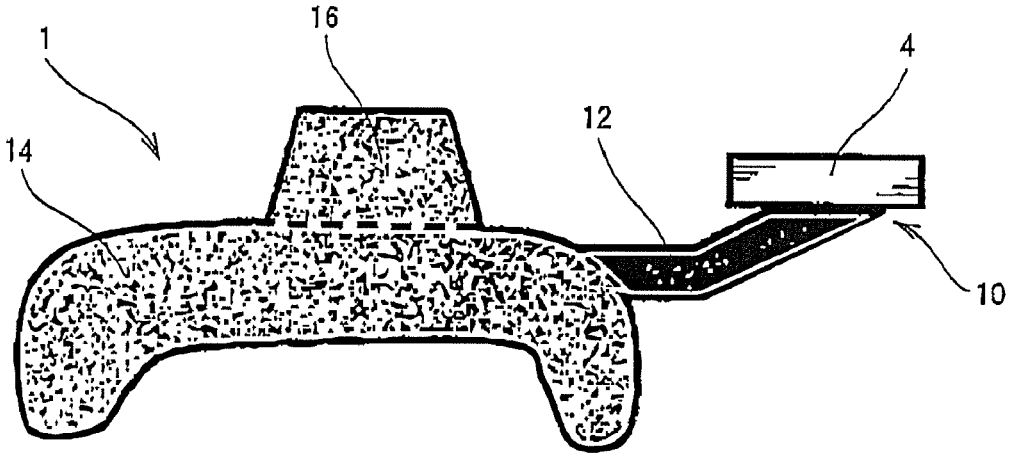
Figure 7:
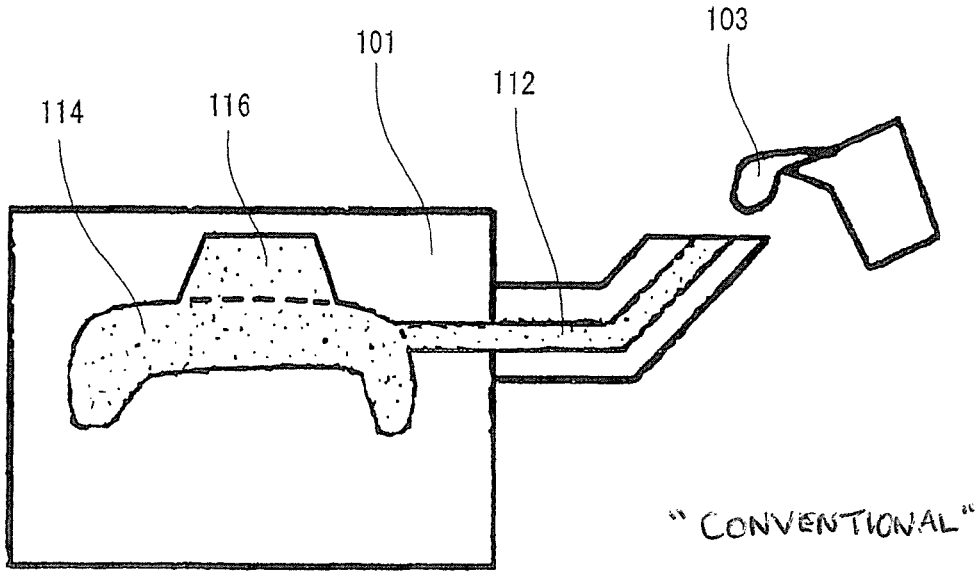
FIG. 7 is an explanatory view for explaining a gravity casting method according to an existent embodiment.
Figure 8:
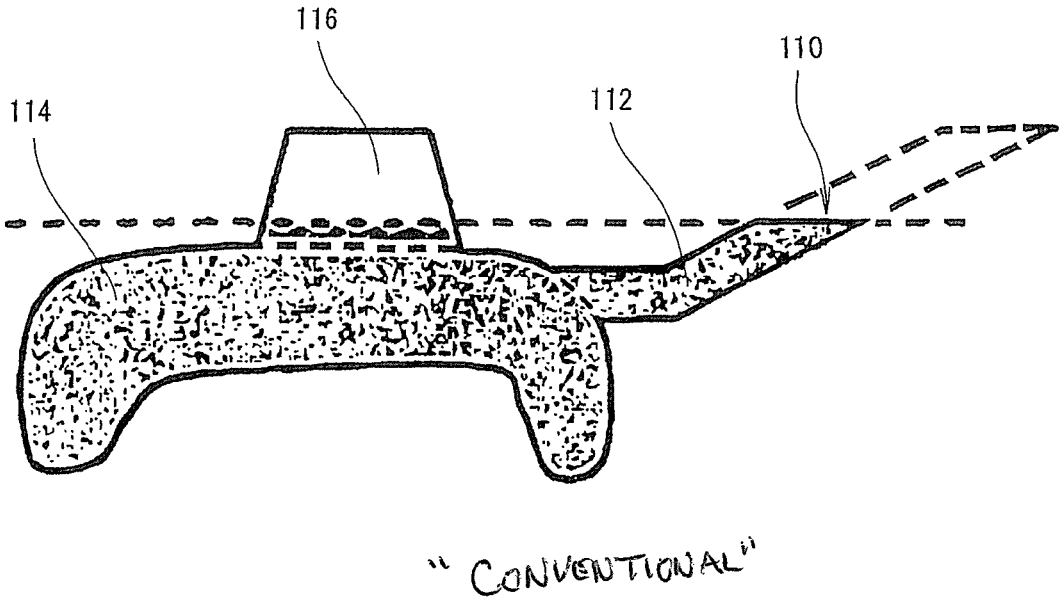
FIG. 8 is an explanatory view for explaining a gravity casting method according to another existent embodiment.
Figure 9:
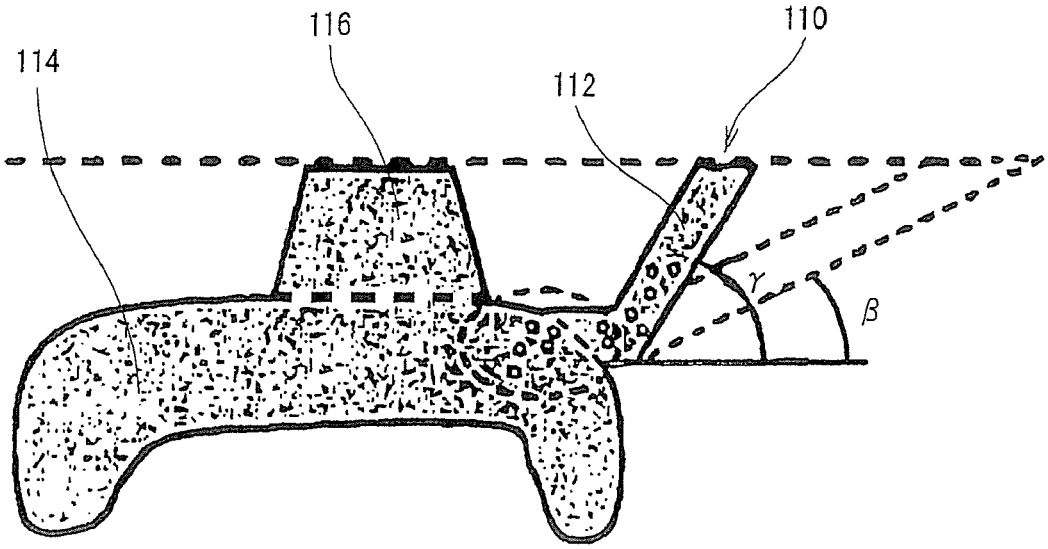
FIG. 9 is an explanatory view for explaining a gravity casting method according to a further existent embodiment.
Figure 10:
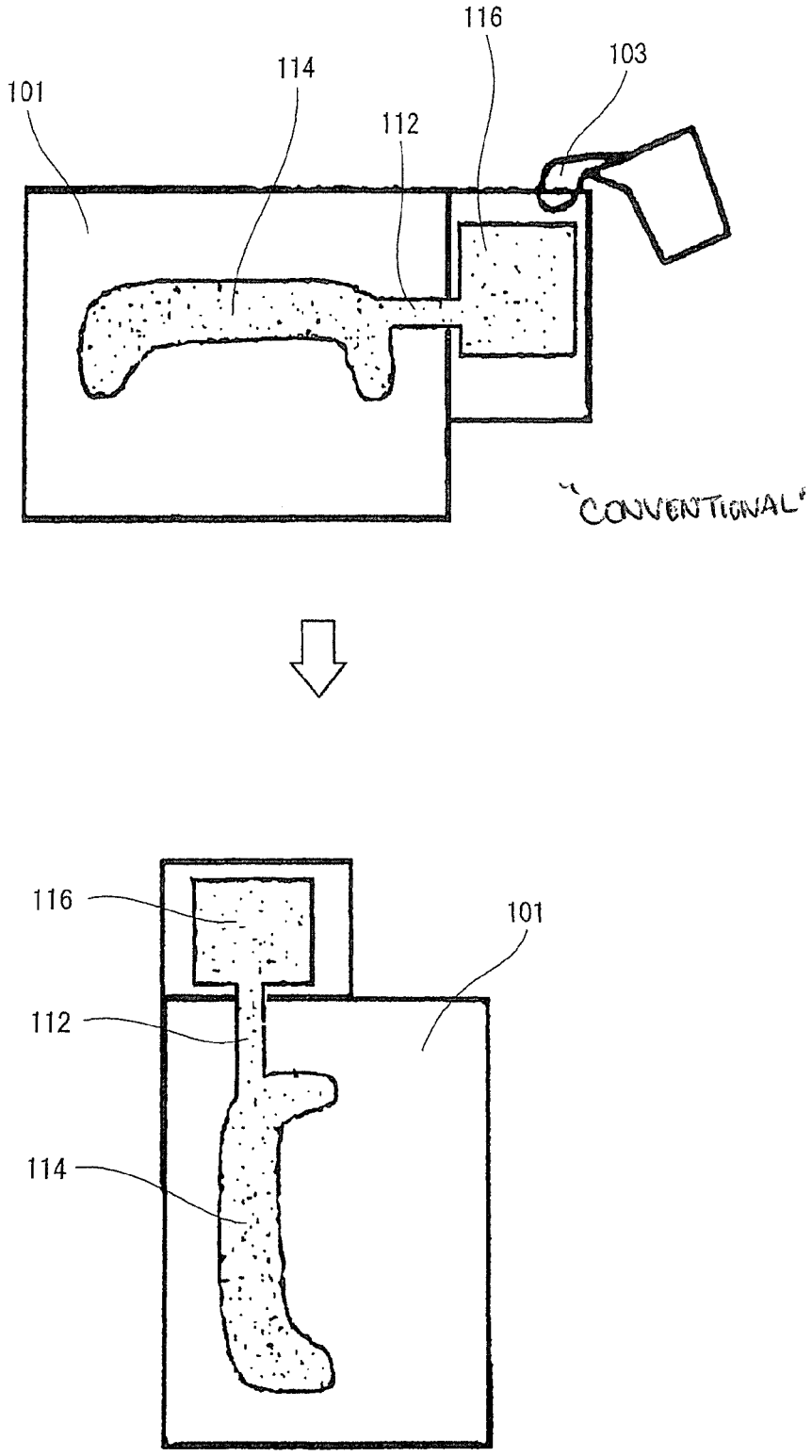
FIG. 10 is an explanatory view for explaining a gravity casting method according to a further existent embodiment.

More specifically, after pouring the molten metal 3 from a ladle 2 to a molding die 1 in a state inclined at a predetermined angle $\alpha$ (described above) and completing the pouring of the molten metal (refer to FIG. 6A), the sprue 10 is closed by a lid member 4 so as not to form gaps through which the molten metal flows backward (refer to FIG. 6B) and, soon after, the turn-back step described above is conducted irrespective of the solidification of the molten metal in the runner 12 (refer to FIG. 6C).

According to the method, the turn-back step can be started instantly after completing the pouring of the molten metal without waiting for the solidification of the molten metal in the runner 12. As a result, the feeder effect of the feeder portion 16 provided in the horizontal state can be obtained in an early stage and product defects such as misrun and shrinkage cavity can be decreased. Further, since the tact time can be shortened further compared with the gravity casting method according to the fourth or the fifth embodiment, the manufacturing cost can be decreased.

As has been described above, according to the disclosed gravity casting method, the molten metal can be filled in the entire inside of the feeder portion even in a molding die having a runner of a shape with a shortened length compared with the runner which is necessary in the existent stationary casting method without changing the tilting angle $\beta$ to a steeper angle, and an amount of feeder melt necessary for prevailing the molten metal as far as the top end of the cavity can be ensured.

Further, since the effect of prevailing the molten metal as far as the top end of the cavity can be provided by the gravitational force of the feeder melt and product defects such as misrun and shrinkage cavity can be decreased, the yield can be improved.

Further, also in a case of a molding product such as a knuckle used for automobiles of a complicated shape having radial components, the quality of the molding product can be maintained at a quality comparable with that of the product which is cast by the gravitational casting method according to the existent stationary casting method and the cost can be decreased.

Needless to say, the invention is not restricted only to the examples described above but can be modified variously within a range not departing from the gist of the invention. While description has been made particularly referring to the examples of using the aluminum alloy as the melt (molten metal), the invention is not restricted thereto.

What is claimed is:

1. A gravity casting method comprising:

situating a molding die having a feeder portion in communication with a cavity above the cavity while in a horizontal state and pouring a molten metal from a runner in communication with the cavity while the molding die is in the horizontal state;

putting, while continuing the pouring, the molding die to a state inclined at a predetermined angle during pouring of the molten metal from a stage where the molten metal is filled in the runner and to the inside of the cavity and the feeder portion; and returning the molding die to the horizontal state after the molten metal has been poured completely, and then solidifying the molten metal in the horizontal state.

2. The gravity casting method according to claim 1, wherein the returning of the molding die is performed after lapse of a predetermined time where the molten metal in the runner is solidified and is not fluidized.

3. The gravity casting method according to claim 1, wherein the returning of the molding die is performed after measuring a temperature of the molding die and lowering of the temperature to a predetermined temperature.

4. The gravity casting method according to claim 3, wherein the temperature of the runner of the molding die is measured as the temperature of the molding die.

5. The gravity casting method according to claim 3, wherein the temperature of the feeder portion of the molding die is measured as the temperature of the molding die.

6. The gravity casting method according to claim 1, wherein the returning of the molding die is performed after a temperature difference between the temperature of the runner and the temperature of the feeder portion increases to a predetermined value or more.

7. The gravity casting method according to claim 1, wherein the returning of the molding die is performed after measuring a temperature of the molten metal in the molding die and lowering of the temperature to a predetermined temperature.

8. The gravity casting method according to claim 1, wherein a portion of the runner is made narrower than other portions.

9. The gravity casting method according to claim 1, further comprising cooling the runner on a side of a sprue before returning the molding die to the horizontal state.

10. The gravity casting method according to claim 1, further comprising cooling the molten metal in the runner on a side of a sprue before returning the molding die to the horizontal state.

11. The gravity casting method according to claim 1, further comprising closing a sprue of the runner before returning the molding die to the horizontal state after completing the pouring of the molten metal.

12. The gravity casting method according to claim 1, wherein the molding die is placed at the inclined state after the runner of the molding die is filled.

13. The gravity casting method according to claim 1, wherein the semi-solidification state is a solid/liquid coexistence state which is dealt as a solid state that exhibits no substantial fluidity.

14. The gravity casting method according to claim 13, wherein the semi-solidification state is about from 570° C. to 600° C.

15. The gravity casting method according to claim 1, further comprising cooling and solidifying the molten metal poured into the cavity when the molding die is returned to the horizontal state.

16. The gravity casting method according to claim 1, further comprising, previous to the gravity casting method, determining a correlation between the temperature of the molten metal in the runner and the temperature of the molten metal in the cavity or the feeder portion by conducting a test casting.

17. The gravity casting method according to claim 16, wherein the returning the molding die to the horizontal state is based on a temperature of the molten metal in the runner being in a non-fluidized state, as found in the test casting.

18. The gravity casting method according to claim 16, wherein the returning the molding die to the horizontal state is based on an elapsed time found for the molten metal in the runner to be in a non-fluidized state, as found in the test casting.

19. The gravity casting method according to claim 1, wherein the narrower portion of the runner is a restricted portion at a midway portion thereof.

20. A gravity casting method comprising:

maintaining a molding die having a cavity and a runner in a horizontal state while pouring a molten metal into the cavity of the molding die;

rotating the molding die to an inclined position at a predetermined angle during pouring of the molten metal;

solidifying or semi-solidifying the molten metal in the runner of the molding die while the molding die is in the inclined position;

returning the molding die from the inclined position to the horizontal state after the pouring is complete and the molten metal in at least a portion of the runner is in a non-fluidized state; and solidifying the molten metal within the cavity while the molding die is in the horizontal state.

* * * * *